US005700154A

United States Patent [19]

Geary

[11] Patent Number: 5,700,154

[45] Date of Patent: Dec. 23, 1997

[54] MULTI-COMPONENT LAMP ADAPTOR ASSEMBLY

[75] Inventor: Brian P. Geary, Holland, Mich.

[73] Assignee: Progressive Technology in Lighting, Inc., Holland, Mich.

[21] Appl. No.: 557,520

[22] Filed: Nov. 14, 1995

[51] Int. Cl.[6] ..... H01R 33/02

[52] U.S. Cl. ..... 439/236; 439/133

[58] Field of Search ..... 439/226, 232, 439/233, 236, 360, 502, 505, 628, 638, 655, 133

[56] References Cited

U.S. PATENT DOCUMENTS

| | | | |
|---|---|---|---|
| 1,080,327 | 12/1913 | Chapman et al. . | |
| 1,110,193 | 9/1914 | Dougherty . | |
| 1,239,005 | 9/1917 | Harris et al. . | |
| 1,287,449 | 12/1918 | Ryder . | |
| 1,583,313 | 5/1926 | Robertson . | |
| 1,593,534 | 7/1926 | Kuhlman . | |
| 1,632,599 | 6/1927 | Hayward . | |
| 1,640,128 | 8/1927 | Kovanda . | |
| 1,644,767 | 10/1927 | Zimmermann . | |
| 1,761,344 | 6/1930 | Huber . | |
| 1,777,187 | 9/1930 | Wayland . | |
| 1,790,239 | 1/1931 | Lawson . | |
| 1,898,498 | 2/1933 | Pokorney . | |
| 2,004,550 | 6/1935 | Bradley . | |
| 2,071,769 | 2/1937 | Schlicker et al. . | |
| 2,372,266 | 3/1945 | Frank . | |
| 2,494,755 | 1/1950 | Grover . | |
| 2,648,049 | 8/1953 | Brayman et al. . | |
| 2,835,878 | 5/1958 | Bauer et al. . | |
| 3,165,370 | 1/1965 | Laub, Sr. . | |
| 3,504,329 | 3/1970 | Peterson et al. . | |
| 3,611,258 | 10/1971 | Kolakowski . | |
| 3,676,835 | 7/1972 | Holly . | |
| 3,885,185 | 5/1975 | Tilley . | |
| 4,623,823 | 11/1986 | Engel | 439/232 |
| 4,723,200 | 2/1988 | Troen | 439/232 |
| 4,886,994 | 12/1989 | Ragge, Jr. . | |
| 5,006,751 | 4/1991 | Marshall . | |
| 5,044,974 | 9/1991 | Pelton et al. . | |
| 5,171,292 | 12/1992 | Ortiz . | |

*Primary Examiner*—Khiem Nguyen
*Assistant Examiner*—Yong Ki Kim
*Attorney, Agent, or Firm*—Van Dyke, Gardner, Linn & Burkhart, LLP

[57] ABSTRACT

A multi-component adaptor assembly for converting an incandescent light fixture for use with another lamp. The adaptor assembly is comprised of an adaptor and a connecting assembly. The connecting assembly has a base that inserts within an Edison socket and a top which connects with the adaptor. The adaptor has a housing having a first connector for receiving a lamp and a second connector for mounting on the top of the connecting assembly.

18 Claims, 5 Drawing Sheets

MULTI-COMPONENT LAMP ADAPTOR ASSEMBLY

BACKGROUND OF THE INVENTION

The present invention relates to a lamp adaptor assembly for converting an incandescent light fixture. The invention is particularly adapted for use with a compact fluorescent lamp but may be used with other light sources, including light-emitting diodes.

Many light fixtures today are designed for incandescent lighting and have the standard threaded socket or Edison socket into which a threaded incandescent bulb is rotatably inserted. However, concerns for energy efficiency have made fluorescent lighting an increasingly attractive alternative to incandescent lighting. As a result, fluorescent adapters have been introduced for converting incandescent light fixtures into fluorescent fixtures which use energy-saving fluorescent bulbs.

A florescent adaptor converts an incandescent light fixture into a florescent fixture by insertion into its threaded Edison socket. In order to insert into an Edison socket, prior art adapters have provided a threaded base portion that is integral with the adaptor housing and which screws into and engages the threads of the Edison socket when the housing is rotated. However, florescent adapters have ballast elements, which may cause the adapters to be somewhat bulky in size and irregular in shape. As such, installation and removal of these prior art adapters is problematic because incandescent light fixtures frequently are in confined environments having obstacles which, although enabling an adaptor to be positioned therein, prevent or hinder rotation of the adaptor housing. For example, the harp structure of conventional table lamps creates a confined area in which rotation of an adaptor housing may be prevented unless the harp is physically removed which, unfortunately, is a time-consuming process. Furthermore, the confined area inherent to most recessed ceiling light fixtures may render the rotation of an adaptor housing difficult or even impossible.

Although fluorescent adapters ultimately save consumers money by enabling energy-efficient fluorescent bulbs to be used, the adapters themselves are relatively expensive. As a result, theft of the adapters is a concern in applications where the adapters are accessible to the public, such as in hotel and motel rooms, public rest rooms, and the like. One type of theft protection feature provided in prior art adapters enables the threaded base portion of an adaptor to rotate independently of the adaptor housing unless a tool is inserted therebetween to frictionally engage the two components together. As such, insertion of the adaptor into and, more importantly, removal from an Edison socket, is prevented without the tool. Although this feature is an effective means of theft protection, the feature is designed to work with and provides complete protection only to adapters which suffer from the installation and removal rotational problems discussed above.

Thus, a fluorescent adaptor assembly is needed which can be conveniently installed in and removed from an Edison socket even in confined incandescent light fixture environments. Furthermore, an adaptor assembly is needed which, while readily installable and removable, provides protection against theft.

SUMMARY OF THE INVENTION

The present invention provides a multi-component lamp adaptor assembly which can be readily installed in and removed from an Edison socket. In the preferred embodiment, an adaptor assembly is provided which, while readily installable and removable, has theft protection features.

The multi-component adaptor assembly of the present invention is comprised of a lamp adaptor and a connecting assembly. The connecting assembly has a base that inserts within an Edison socket and a top which connects with the adaptor. The adaptor has a housing having a first connector for receiving a lamp and a second connector for electrical interconnection with the top of the connecting assembly.

In the preferred embodiment, the base of the connecting assembly includes a male screw-in element that engages the threads of an Edison socket and is freely rotatable relative to an inner wall portion. A tool is provided for selectively preventing rotation of the Edison socket to allow the adaptor assembly to be unscrewed only with the use of the tool. Furthermore, a retaining member is provided to positively lock the adaptor housing and connecting assembly together until disengaged by the tool member. In this manner, the tool is multi-functional.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
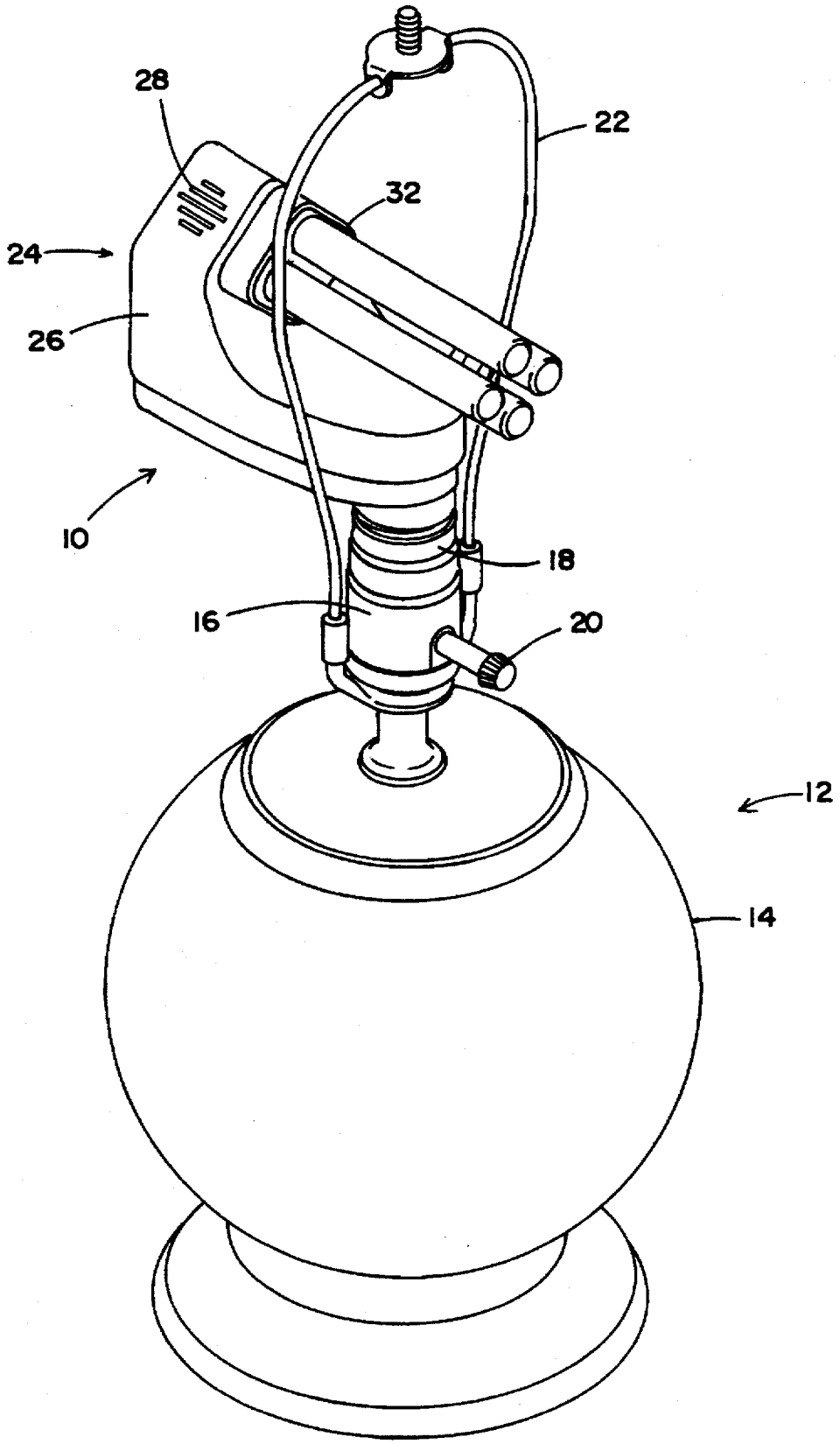
FIG. 1 is a perspective view of a table lamp having a multi-component adaptor assembly according to the present invention.
Figure 2:
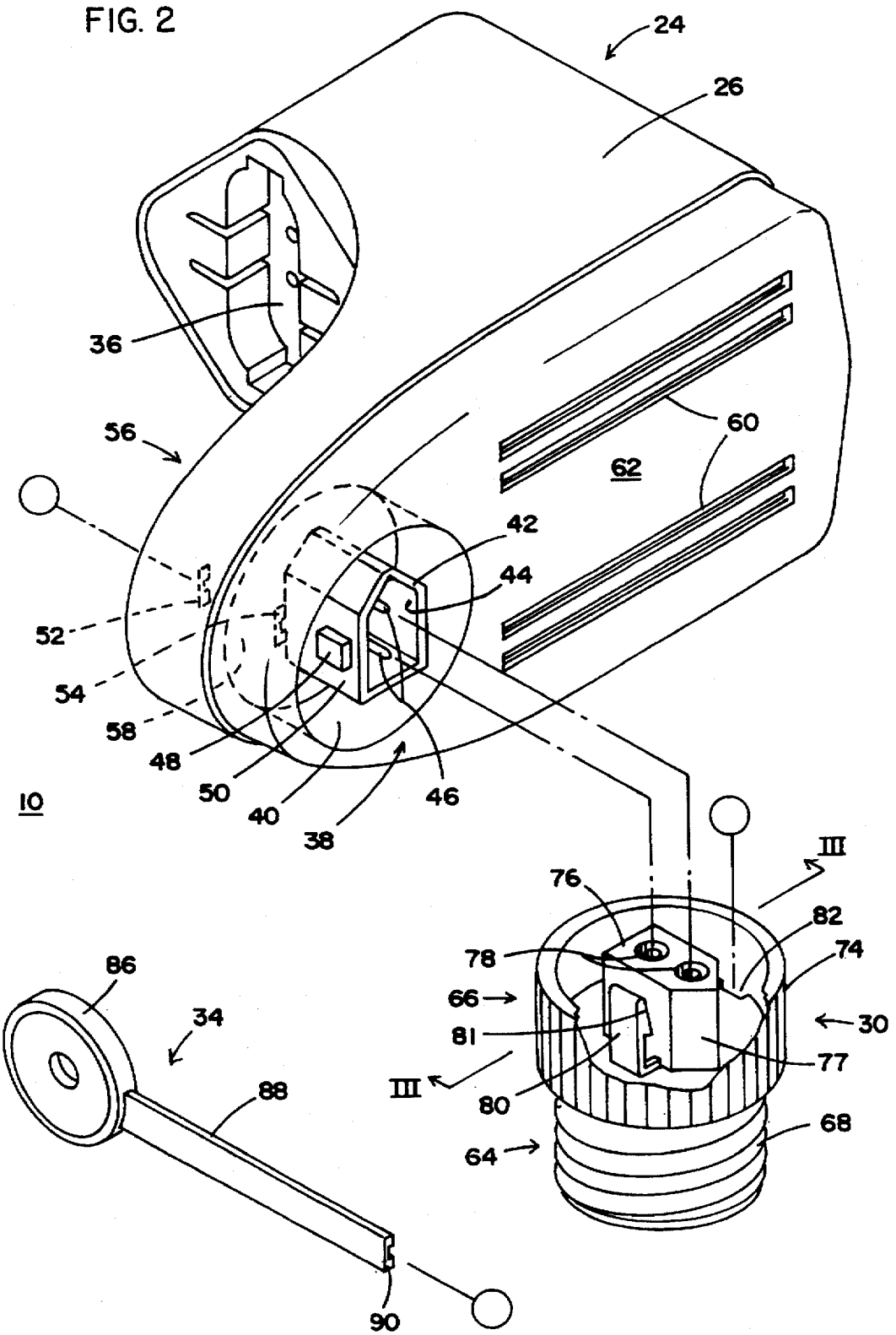
FIG. 2 is an exploded perspective view of the adaptor assembly.

Referring now specifically to the drawings and to the illustrative embodiments depicted therein, a lamp adaptor assembly 10 according to the present invention is illustrated in connection with a table lamp 12 having a lamp base 14, an incandescent light fixture 16 including an Edison socket 18 and an on/off knob 20, and a harp 22 (FIG. 1). Adaptor assembly 10 includes an adaptor 24 having an adaptor housing 26, and is connected with socket 18 of lamp 12 with a connecting assembly 30 (FIG. 2). Housing 26 has air vents 28 and may house a conventional magnetic or electronic ballast. Inserted into adaptor assembly 10 is a lamp 32 which, in the illustrated embodiment, is a four-pronged fluorescent bulb from which fluorescent light is emitted. Lamp 32 could, alternatively, be a different form of gas discharge lamp, a light-emitting diode (LED) lamp, a quartz lamp, or the like. As shown in FIG. 1, harp 22 of lamp 12 creates a confined environment within the vicinity of incandescent light fixture 16 such that rotation of a typical adaptor assembly 10 along a horizontal plane would be seriously hindered or prevented.

FIG. 2 shows the individual parts of adaptor assembly 10 and their method of interconnection. Shown is adaptor 24, a connecting assembly 30, and a tool member 34. Housing 26 of adaptor 24 has a conventional fluorescent ballast (not shown) contained therein and which is electrically interconnected with a first connector or receptacle 36 for receiving a fluorescent bulb 32 (FIG. 1) and a second connector or receptacle 38 for connection with connecting assembly 30. Second connector 38 includes a shaped recessed pocket 40 surrounding an enclosure 42 having a shaped inner surface 44 with male conductive members 46 contained therein. A catch-tab 48 is located on the outer surface 50 of enclosure 42. A first aperture 52 and a second aperture 54 are located on the top face 56 of housing 26 and the internal wall 58 of recessed pocket 40, respectively, and are shaped for insertion of tool member 34 therein, as described in greater detail below. Air vents 60 are also shown on the bottom face 62 of housing 26 which prevent overheating of internal adaptor elements.

Connecting assembly 30 includes a base 64 and a top 66. Base 64 includes a threaded male screw-in element 68 that is screwably insertable within an Edison socket 18 (FIG. 1). Base 64 also has an inner wall portion 70 (FIG. 3) having an outer surface 72. Element 68 is held in surrounding relationship and is freely rotatable relative to said outer surface of said wall portion 70. Attached to wall portion 70 of base 64 is top 66 which includes a nonconductive platform 74 providing a handle which, as described below, enables base 64 to be safely screwed into the Edison socket without the risk of electrocution. Platform 74 is shaped for insertion within recessed pocket 40 of housing 26. Because of the connection between top 66 and wall portion 70 (FIG. 3), element 68 is freely rotatable relative to top 66. Top 66 of connecting assembly 30 also includes a protrusion 76 positioned in the middle of platform 74 having an outer surface 77 which is shaped for insertion within enclosure 42 of second connector 38 of housing 26. Protrusion 76 has female connecting receptacles 78 therein that receive male conductive members 46 of housing 26 when protrusion 76 is inserted into enclosure 42. Female connecting receptacles 78 are electrically connected to socket 18 upon insertion of base 64 therein. A retaining member 80 is attached to the outer surface 77 of protrusion 76 and is shaped to engage catch-tab 48 of housing 26 when protrusion 76 is inserted into enclosure 42. In the preferred embodiment, retaining member 80 is hook-like in shape and includes a ramp 81 for reasons discussed below. In addition, an opening 82 (FIGS. 2 and 4) is provided in top 66 in the preferred embodiment that creates a recess or space between element 68 and outer surface 72 (FIG. 3) of wall portion 70. Opening 82 is shaped for insertion of tool member 34 into this recess, as shown in FIG. 3 and described in greater detail below.

Tool member 34 includes a handle 86 connected to an elongated arm 88 having an end 90. Tool member 34 is used in connection with a two-part theft protection system of the preferred embodiment of the adaptor assembly. As described in greater detail below, arm 88 and end 90 are shaped to permit insertion into first aperture 52, second aperture 54, and opening 82.

Figure 3:
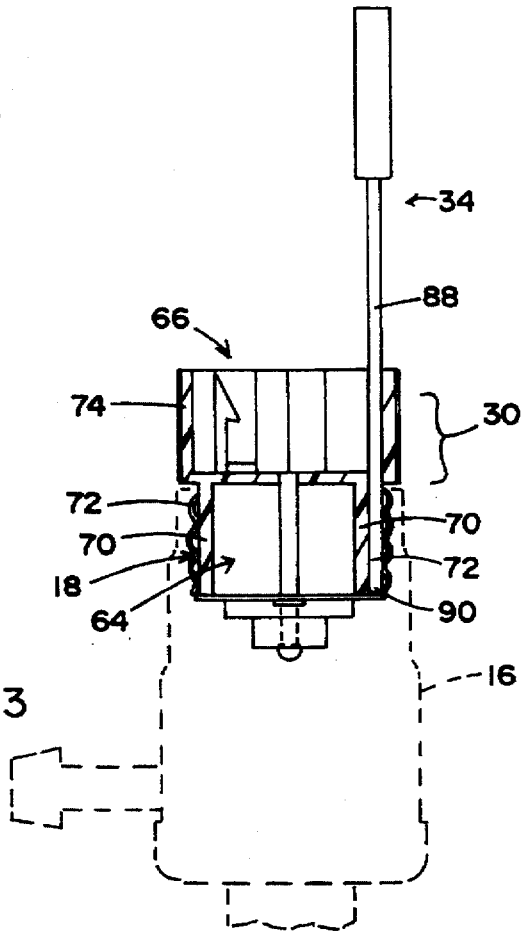
FIG. 3 is a sectional view, taken along the plane III—III of FIG. 2, illustrating the connecting assembly of the adaptor assembly inserted within a standard Edison socket shown in phantom.

As shown in FIG. 3, the first step in converting an incandescent light fixture 16 (shown in phantom) into a fluorescent fixture involves the insertion of base 64 of connecting assembly 30 into an Edison socket 18 by means of rotation of insulated top 66 and, thereby, threaded male screw-in element 68 (FIG. 2) such that the threads of socket 18 are engaged. However, as described above, element 68 (FIG. 2) is freely rotatable relative to top 66 including platform 74. As such, rotation of element 68 (FIG. 2) for insertion into and removal from socket 18 requires a means by which to engage element 68 to wall portion 70 such that rotation of platform 74 causes rotation of element 68. This requirement is designed into the adaptor assembly of the present invention to provide one means of theft protection. In the preferred embodiment, tool member 34 is provided having end 90 and arm 88 which are shaped for insertion into correspondingly shaped opening 82 (FIG. 2) of top 66 to frictionally engage wall portion 70 and element 68 together (FIG. 3) so that element 68 can be rotated. The size of platform 74 and top 66 are preferably kept to a minimum so that element 68 can be rotated in confined incandescent light fixture environments.

Figure 4:
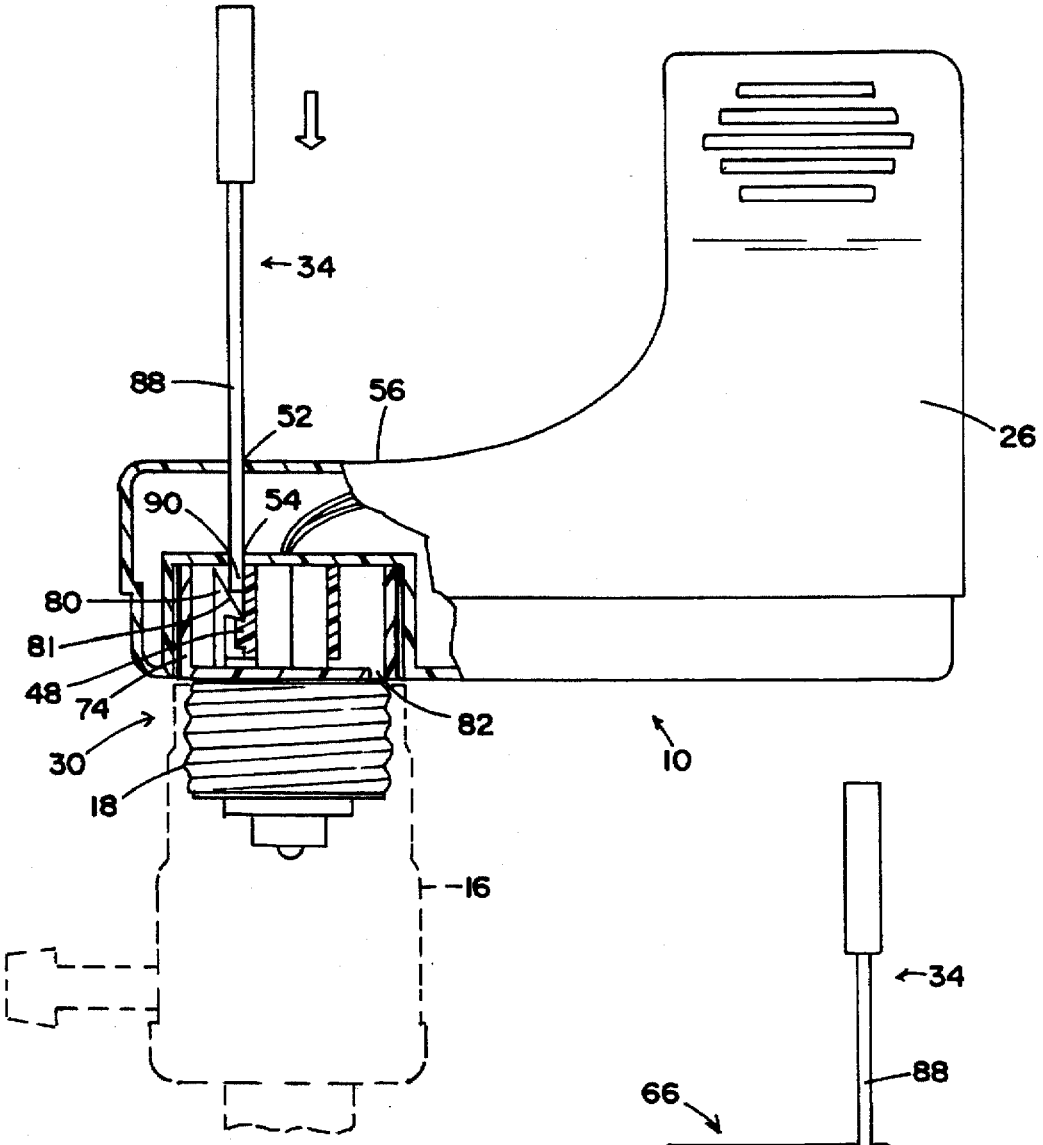
FIG. 4 is a view, similar to that of FIG. 3, with the adaptor of the adaptor assembly mounted on the connecting assembly.

Once base 64 of connecting assembly 30 is inserted into an Edison socket as described above, adaptor housing 26 is then mounted thereon by means of insertion of platform 74 and protrusion 76 into recessed pocket 40 and enclosure 42, respectively, of second connector 38 (FIGS. 2 and 4). This connection does not require rotation of adaptor housing 26 such that adaptor assembly 10 can be mounted in confined environments such as that shown in FIG. 1. Connection, however, requires that protrusion 76 and enclosure 42 (FIG. 2) be aligned so that their respective shapes coincide with one another. Furthermore, housing 26, and thus enclosure 42, may need to be in a certain position relative to incandescent light fixture 16 in order to be mounted in a confined environment. For example, shown in FIG. 1 is the situation where housing 26 must be positioned to avoid the harp 22 of lamp 12 when mounted on connecting assembly 30. Therefore, the positioning of protrusion 76 (FIG. 2) of connecting assembly 30 may need to be adjusted, after full insertion of element 68 into socket 18, in order to align with enclosure 42 to enable insertion therein. Since top 66 (FIG. 2) is freely rotatable relative to element 68 when tool member 34 is not inserted within opening 82, any such adjustment of the positioning of protrusion 76 can readily be achieved.

When shaped protrusion 76 is inserted into correspondingly shaped enclosure 42 in order to mount housing 26 onto connecting assembly 30 (FIG. 4), male conductive members 46 of enclosure 42 are received within female connecting receptacles 78 of protrusion 76, as shown in FIG. 2. This provides an electrical connection between socket 18 and the ballast within housing 26. In addition, retaining member 80 engages catch-tab 48 upon full insertion of protrusion 76 into enclosure 42 (FIG. 2) so as to positively lock housing 26 and connecting assembly 30 together. This locking is desirable in situations where a purely frictional connection may be insufficient such as when the adaptor assembly is installed upside down in a recessed ceiling light fixture. Furthermore, retaining member 80 and catch-tab 48 provide a second means of theft protection which, as is described below, requires the use of tool member 34 to separate housing 26 from connecting assembly 30.

Thus, upon insertion of base 64 of connecting assembly 30 into socket 18 and mounting of housing 26 thereon, incandescent light fixture 16 is converted into a fluorescent fixture. Fluorescent lighting is then provided by insertion of a fluorescent bulb 32 into first connector 36, and by the conventional operation of incandescent light fixture 16 by means of knob 20. In addition, because adaptor housing 26 is connected to top 66 of connecting assembly 30, housing 26 is freely rotatable with respect to element 68 and can be rotated after installation in order to more precisely select the final position of the fluorescent bulb.

As described above, the adaptor assembly of the present invention can convert an incandescent light fixture into a fluorescent fixture. However, the adaptor assembly can also be removed to once again enable incandescent lighting to be provided. The first step in removing the adaptor assembly involves separating the adaptor housing 26 from connecting assembly 30. To accomplish this, retaining member 80 and catch-tab 48 are disengaged. This provides a second means of theft protection for the multi-component adaptor assembly of the present invention. As shown in FIG. 4, retaining member 80 and catch-tab 48 are disengaged by insertion of tool member 34 into first and second apertures 52 and 54 located on the top face 56 of housing 26 and the internal wall 58 (FIG. 2) of recessed pocket 40, respectively. Insertion of tool member 34 into first and second apertures 52 and 54 eventually causes end 90 to contact retaining member 80 which is supported on catch-tab 48. Specifically, end 90 of tool member 34 contacts ramp 81 of retaining member 80 and acts as a wedge so as to forcibly disengage retaining member 80 from catch-tab 48 upon full insertion of tool member 34 when end 90 contacts catch-tab 48. While tool member 34 is in a fully inserted state, adaptor housing 26 can be readily separated from connecting assembly 30 by sliding enclosure 42 and recessed pocket 40 off of protrusion 76 and platform 74 (FIG. 2).

Once adaptor housing 26 is separated from connecting assembly 30, the final step in removing the adaptor assembly involves rotation of male screw-in element 68 (FIG. 2) out of socket 18. As described above, element 68 is freely rotatable relative to wall portion 70 (FIG. 3) and top 66 connected thereto. As a result and as a means of theft protection, tool member 34 must be inserted into opening 82 (FIG. 2) to frictionally engage wall portion 70 and element 68 together (FIG. 3) to enable rotation of platform 74 to cause rotation of element 68 out of socket 18. When element 68 is removed, socket 18 can once again receive an incandescent light bulb so that incandescent lighting may again be provided.

Figure 5:
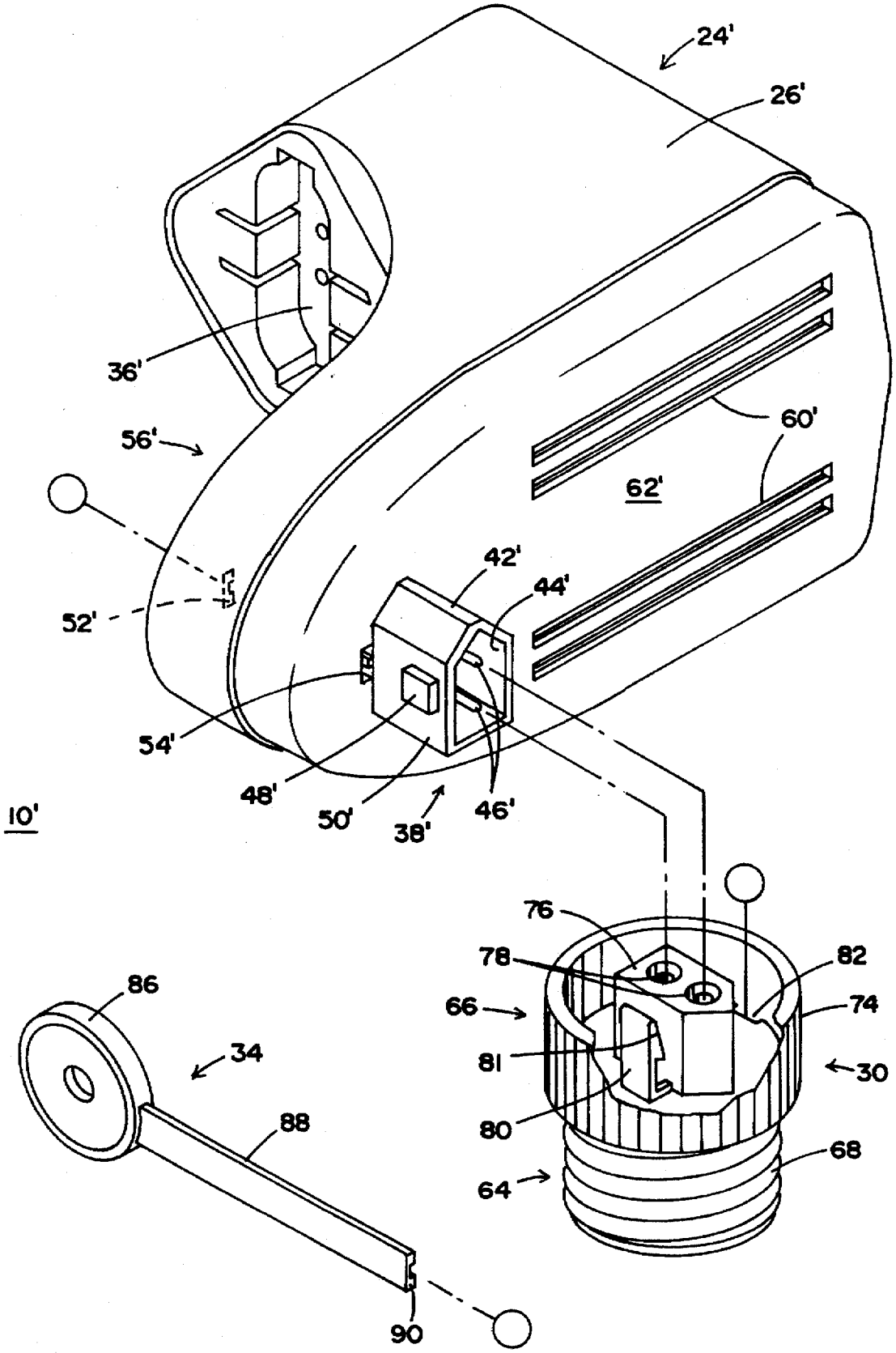
FIG. 5 is an exploded view of an alternate embodiment of the adaptor assembly.
Figure 6:
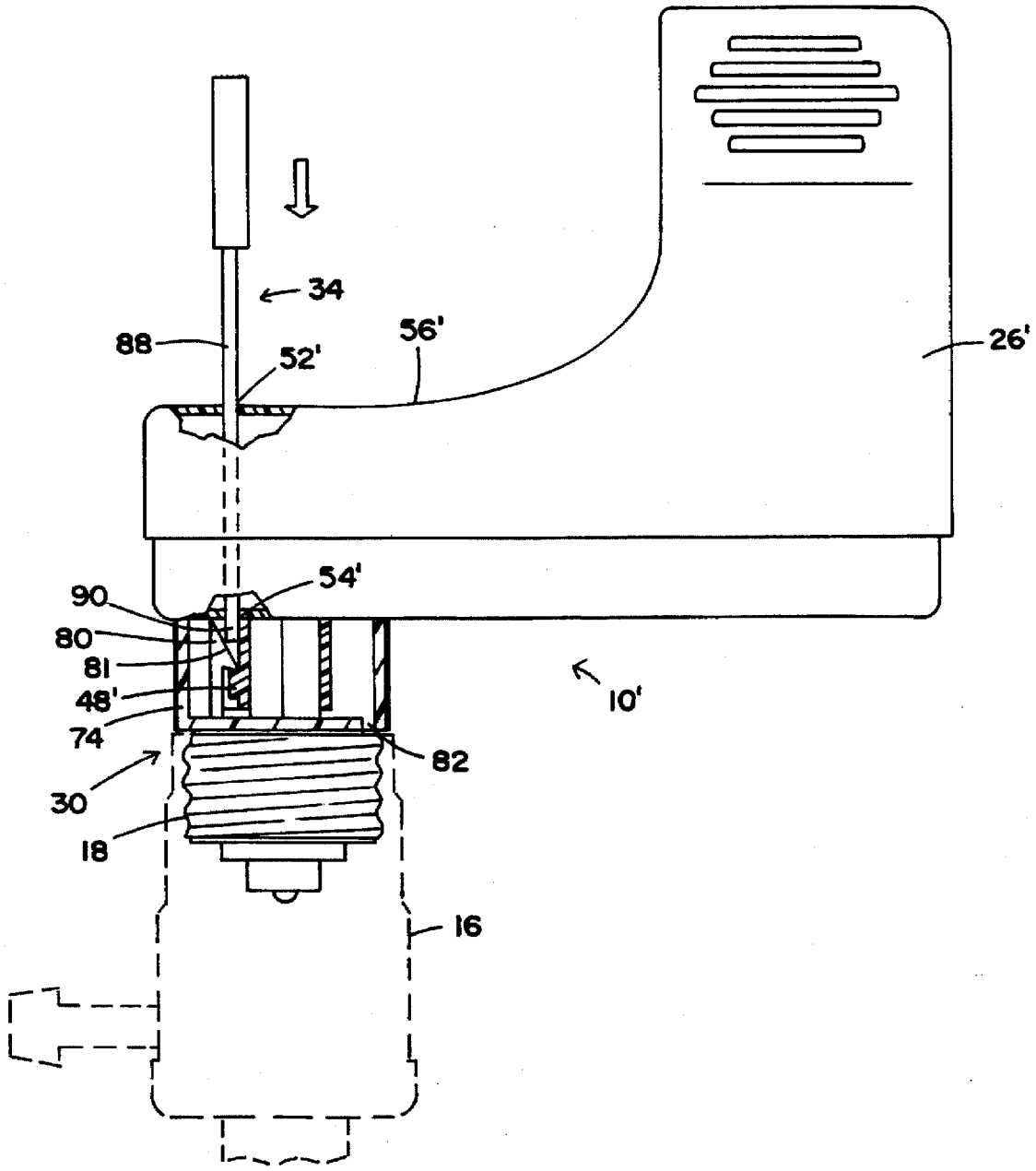
FIG. 6 is a side cross-sectional view, similar to that of FIG. 4, of the embodiment in FIG. 5.

An alternate embodiment of the adaptor assembly 10' of the present invention is shown in FIGS. 5 and 6. In this embodiment, second connector 38' of housing 26' does not have a recessed pocket. Instead, an enclosure 42' is mounted on the bottom face 62' of housing 26'. Bottom face 62' also serves as the location for second aperture 54' through which tool member 34 extends in order to disengage retaining member 80 from catch-tab 48' in a fully assembled adaptor assembly, as shown in FIG. 6. Except for the absence of a recessed pocket 40 (FIG. 2), the structure and operation of the alternate embodiment is the same as the preferred embodiment. The use of recessed pocket 40 (FIG. 2) is preferred in most applications because it reduces the overall height of the adaptor assembly by receiving all of top 66 when housing 26 is mounted on connecting assembly 30. This may be advantageous for installing the adaptor assembly in confined light fixture environments. However, the positioning of enclosure 42' on the bottom face 62' of housing 26' in the alternate embodiment may simplify insertion of protrusion 76 within enclosure 42' (FIG. 5) by enabling the connection to be more easily viewed.

As described above, the present invention provides a multi-component adaptor assembly which can be readily installed in and removed from an Edison socket even in confined incandescent light fixture environments. Furthermore, an adaptor assembly is provided which, while readily installable and removable, has theft protection features.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

The embodiments of the invention in which an exclusive property or privilege is claimed are defined as follows:

1. A lamp adaptor assembly for adapting an internally threaded electrical socket for use with a lamp, comprising:

a connecting assembly having a top, a base, and a first connector on said top electrically interconnected with said base, said base configured for inserting within and electrically engaging a threaded electrical socket; and an adaptor having an irregularly shaped housing, a second connector for receiving a lamp, a third connector for engaging said first connector of said connecting assembly, and a ballast in said housing electrically interconnected with said second and third connectors, wherein said housing extends laterally irregularly from said third connector;

wherein said adaptor is rotationally movable with respect to said base when said adaptor is engaged with said connecting assembly, wherein said adaptor assembly can be mounted in locations too restricted for rotation of said irregularly shaped housing by engaging said connecting assembly with an internally threaded electrical socket, and engaging said second and third connectors and rotating said irregularly shaped housing to a desired orientation.

2. The adaptor assembly as defined in claim 1 wherein said third connector is axially engageable with said first connector of said connecting assembly.

3. The adaptor assembly as defined in claim 1 wherein said base of said connecting assembly includes a threaded male screw-in element for engaging the threads of the incandescent lamp socket.

4. The adaptor assembly as defined in claim 1 wherein said top of said connecting assembly includes a nonconductive platform.

5. The adaptor assembly as defined in claim 1 wherein at least one of said first and said third connectors includes a retaining member for positively locking said connecting assembly and said adaptor together.

6. The adaptor assembly as defined in claim 5 wherein said retaining member is hook-like in shape.

7. The adaptor assembly as defined in claim 5 further including a tool member for unlocking said retaining member to enable said connecting assembly and said adaptor to be separated.

8. A lamp adaptor assembly for adapting an internally threaded electrical socket for use with a lamp, comprising:

a connecting assembly having a top and a base, said base configured for inserting within and engaging a threaded electrical socket;

an adaptor having a housing, a first connector for receiving a lamp and a second connector for engaging said top of said connecting assembly;

wherein at least one of said top and said second connector includes a retaining member for positively locking said connecting assembly and said adaptor together; and a tool member for unlocking said retaining member to enable said connecting assembly and said adaptor to be separated;

wherein said housing has a top face having a first aperture and said second connector has an internal wall having a second aperture, and wherein said tool member is inserted through said first aperture and said second aperture to unlock said retaining member.

9. The adaptor assembly as defined in claim 8 wherein said retaining member includes a ramp for guiding said tool member.

10. A lamp adaptor assembly for adapting an internally threaded electrical socket for use with a lamp, comprising:

a connecting assembly having a top and a base, said base configured for inserting within and engaging a threaded electrical socket;

an adaptor having a housing, a first connector for receiving a lamp and a second connector for engaging said top of said connecting assembly;

wherein at least one of said top and said second connector includes a retaining member for positively locking said connecting assembly and said adaptor together; and a tool member for unlocking said retaining member to enable said connecting assembly and said adaptor to be separated;

wherein said base of said connecting assembly includes a wall portion having an outer surface and a threaded male screw-in element for engaging the threads of the incandescent lamp socket, wherein said element is held in surrounding relationship relative to said outer surface of said wall portion, and wherein said element is freely rotatable relative to said outer surface unless said tool member is inserted therebetween to engage said element and said wall portion together.

11. The adaptor assembly as defined in claim 10 wherein said top of said connecting assembly has an opening through which said tool member inserts to engage said element and said wall portion together.

12. A lamp adaptor assembly for adapting an internally threaded electrical socket for use with a lamp, comprising:

a connecting assembly having a top and a base, said base configured for inserting within and engaging a threaded electrical socket;

an adaptor having a housing, a first connector for receiving a lamp and a second connector for engaging said top of said connecting assembly; and a tool member, wherein said base of said connecting assembly includes a wall portion having an outer surface and a threaded male screw-in element for engaging the threads of the incandescent lamp socket, wherein said element is held in surrounding relationship relative to said outer surface of said wall portion, and wherein said element is freely rotatable relative to said outer surface unless said tool member is inserted therebetween to engage said element and said wall portion together.

13. The adaptor assembly as defined in claim 12 wherein said top of said connecting assembly has an opening through which said tool member inserts to engage said element and said wall portion together.

14. A lamp adaptor assembly for adapting an internally threaded electrical socket for use with a lamp, comprising:

a connecting assembly having a top and a base, said base including a threaded male screw-in element for inserting within, and engaging the threads of, a threaded electrical socket, said top including a nonconductive platform;

an adaptor having a housing, a first connector for receiving a lamp, and a second connector for axially engaging said top of said connecting assembly;

wherein at least one of said top and said second connector includes a retaining member for positively locking said connecting assembly and said adaptor together; and a tool member for unlocking said retaining member to enable said connecting assembly and said adaptor to be separated;

wherein said base of said connecting assembly includes a wall portion having an outer surface, wherein said threaded male screw-in element is held in surrounding relationship relative to said outer surface, and wherein said element is freely rotatable relative to said outer surface unless said tool member is inserted therebetween to engage said element and said wall portion together.

15. The adaptor assembly as defined in claim 14 wherein said top of said connecting assembly has an opening through which said tool member inserts to engage said element and said wall portion together.

16. A lamp adaptor assembly for adapting an internally threaded electrical socket for use with a lamp, comprising:

a connecting assembly having a top and a base, said base including a threaded male screw-in element for inserting within and engaging the threads of a threaded electrical socket, said top including a nonconductive platform and a retaining member;

an adaptor having a housing, a first connector for receiving a lamp, and a second connector for axially engaging said top of said connecting assembly; and a tool member;

wherein said retaining member positively locks said connecting assembly and said adaptor together when said second connector and said top are axially engaged, and wherein said connecting assembly and said adaptor remain locked together until said retaining member is unlocked by engagement with said tool member;

wherein said base of said connecting assembly includes a wall portion having an outer surface, wherein said threaded male screw-in element is held in surrounding relationship relative to said outer surface, and wherein said element is freely rotatable relative to said outer surface unless said tool member is inserted therebetween to engage said element and said wall portion together.

17. The adaptor assembly as defined in claim 16 wherein said top of said connecting assembly has an opening through which said tool member inserts to engage said element and said wall portion together.

18. A fluorescent adaptor assembly for adapting an internally threaded incandescent lamp socket for use with a fluorescent bulb, comprising:

a connecting assembly having a top and a base, said top including a nonconductive platform and a retaining member, said base including a wall portion having an outer surface and a threaded male screw-in element for engaging the threads of an incandescent lamp socket, said element held in surrounding relationship relative to said outer surface;

a fluorescent adaptor having a housing, a first connector for receiving the fluorescent bulb, and a second connector for axially engaging said top of said connecting assembly;

a tool member; and wherein said retaining member positively locks said connecting assembly and said adaptor together when said second connector and said top are axially engaged, wherein said connecting assembly and said adaptor remain locked together until said retaining member is unlocked by engagement with said tool member, and wherein said element is freely rotatable relative to said outer surface of said wall portion unless said tool member is inserted therebetween to engage said element and said wall portion together.

* * * * *